US005876020A

United States Patent [19]

Giavotto

[11] Patent Number: 5,876,020

[45] Date of Patent: Mar. 2, 1999

[54] HIGH-PERFORMANCE DEFORMABLE STEEL GUARDRAIL

[75] Inventor: Vittorio Giavotto, Milan, Italy

[73] Assignee: Autostrada del Brennero S.P.A., Trento, Italy

[21] Appl. No.: 864,642

[22] Filed: May 29, 1997

[30] Foreign Application Priority Data

May 30, 1996 [IT] Italy ..... MI96A1104

[51] Int. Cl.[6] ..... A01K 3/00

[52] U.S. Cl. ..... 256/13.1; 256/1; 256/21; 256/59; 404/6; 404/9; 404/10

[58] Field of Search ..... 256/13.1, 1, 65, 256/59, 21; 404/6, 9, 10

[56] References Cited

U.S. PATENT DOCUMENTS

| | | | |
|---|---|---|---|
| 1,847,025 | 2/1932 | Stockard | 256/13.1 |
| 2,907,552 | 10/1959 | Crone | 256/13.1 |
| 3,438,611 | 4/1969 | Giavotto et al. | 256/13.1 |
| 3,476,362 | 11/1969 | Thompson | 256/13.1 |
| 3,966,173 | 6/1976 | Glaesener | 256/13.1 |
| 5,022,782 | 6/1991 | Gertz et al. | 256/13.1 X |
| 5,069,567 | 12/1991 | Pomero | 256/13.1 X |
| 5,203,543 | 4/1993 | Fleury | 256/13.1 |
| 5,261,647 | 11/1993 | Venegas, Jr. et al. | 256/13.1 |
| 5,391,016 | 2/1995 | Ivey et al. | 256/13.1 X |
| 5,660,496 | 8/1997 | Muller et al. | 256/13.1 X |

FOREIGN PATENT DOCUMENTS

| | | | |
|---|---|---|---|
| 452205 | 10/1991 | European Pat. Off. | 256/13.1 |
| 432573 | 9/1967 | Switzerland | 256/13.1 |

*Primary Examiner*—Daniel P. Stodola
*Assistant Examiner*—Bruce A. Lev
*Attorney, Agent, or Firm*—Burns, Doane, Swecker & Mathis, L.L.P.

[57] ABSTRACT

A guardrail for a road or highway includes spaced uprights or posts on which are mounted deformable spacers which carry a longitudinal rail. The rail is formed by two wave shaped strips mounted together in a FIG. 8 profile by fastening ribs positioned in the open areas of the FIG. 8. The spacer has a straight lower portion that extends diagonally upward from the upright to the rail, a center portion fastened to the rail, and an upper portion curved to meet the upright. The spacer deforms to lift the rail upon impact. Additional tubular rails are provided on the uprights above the rail height.

19 Claims, 6 Drawing Sheets

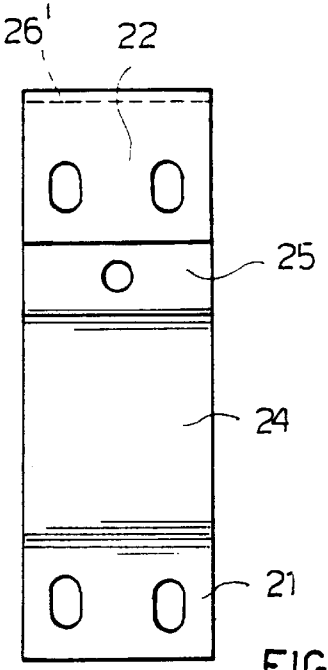
FIG. 7
FIG. 5
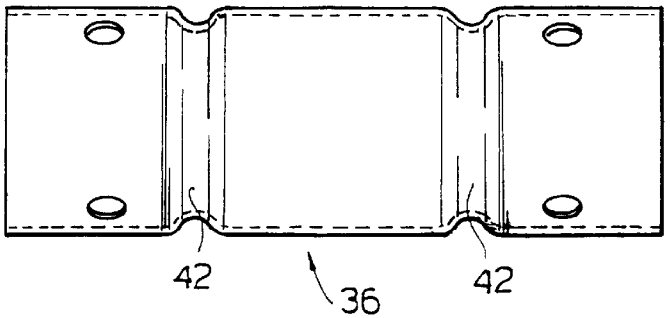
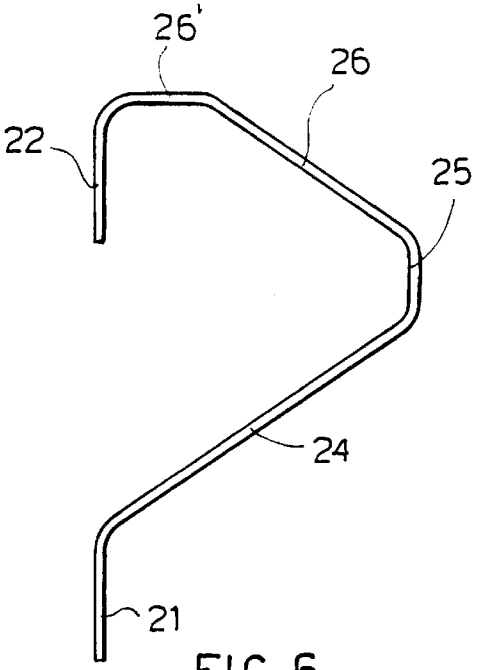
FIG. 6
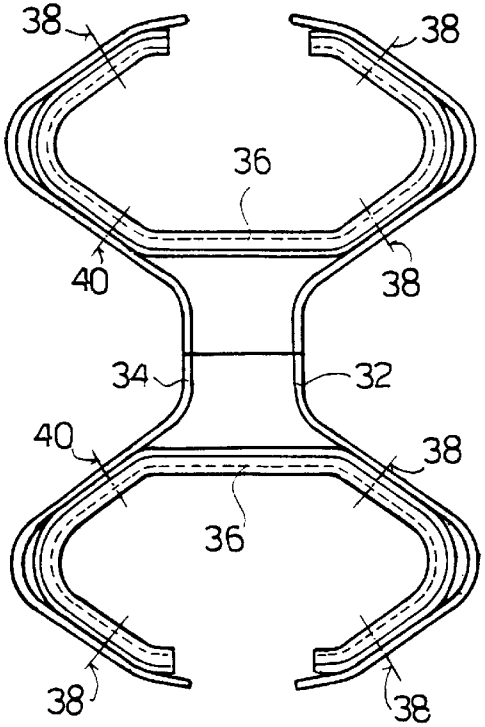
FIG. 3
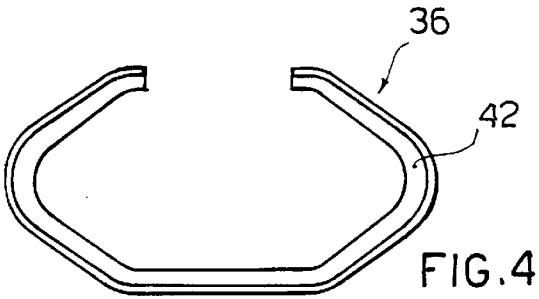
FIG. 4

HIGH-PERFORMANCE DEFORMABLE STEEL GUARDRAIL

BACKGROUND AND SUMMARY OF THE INVENTION

The invention refers to a guardrail for roads.

Various types of guardrails are known, both of metal and of concrete. In particular, a widely used guardrail has a longitudinal rail made of sheet metal with a curved profile, fixed at intervals to posts set in the ground, and placed at a height of about 50 cm, substantially corresponding to the height of the center of gravity of the passenger vehicles generally in use. The functions of guardrails are to keep a vehicle that hits them inside the carriageway, to prevent it as far as possible from assuming attitudes that would be dangerous for the passengers or for other vehicles and to absorb as much of the force of the impact of the vehicle as possible. Although guardrails of the most recent known types represent a considerable improvement with respect to the earlier ones, there is nevertheless always a tendency in the field to improve this product for safety purposes.

An aim of the present application is to obtain an improved performance from guardrails as far as safety is concerned, for both heavy and light vehicles.

More precisely the aim is to create a guardrail that is able to absorb high impact forces, for example when struck by a heavy vehicle such as a truck or the like, and that is able to keep the vehicle on the carriageway in such an attitude as to minimize any injury to the occupants.

A further aim is to create such a guardrail that can be produced at an economically acceptable cost.

A further aim is to create such a barrier that is highly durable.

These aims have been achieved with the guardrail as defined in the following detailed description.

More particularly, the guardrail of the invention comprises, on vertical uprights or posts, fixed in the ground and spaced apart, a longitudinal rail formed by a pair of sheet metal strips with a double-wave profile arranged specularly to each other and connected at intervals by steel ribs or brackets, the longitudinal rail being supported on the uprights by means of deformable spacers. In some variants the guardrail can be made with further continuous horizontal elements fixed to uprights over the longitudinal rail and set at a distance therefrom. The spacer can possibly be made with side flanges, so that as it is deformed against the upright, it can enfold it and prevent undesirable crosswise shifting between the upright and the longitudinal rail.

The strips and the ribs are preferably made of COR-TEN steel. The new barrier is able to absorb high impact forces. It is also able to keep vehicles on the road, even high, heavy vehicles, allowing a certain amount of rolling but preventing overturning. It is durable. Lastly, it allows drivers a good view because any longitudinal elements have a reduced height.

BRIEF DESCRIPTION OF THE DRAWINGS

The invention will be described in greater detail below, purely by way of non-limiting example with reference to the appended figures in which:

FIG. 3 is an end view of the longitudinal rail of the barrier, in a part where it is provided with ribs;

FIG. 4 is an end view of a rib element;

FIG. 5 is bottom view of a rib element;

FIG. 6 is an end view of a spacer;

FIG. 7 is a view from the left with respect to FIG. 6, that is a rear view of a spacer element;

DETAILED DESCRIPTION

Figure 1:
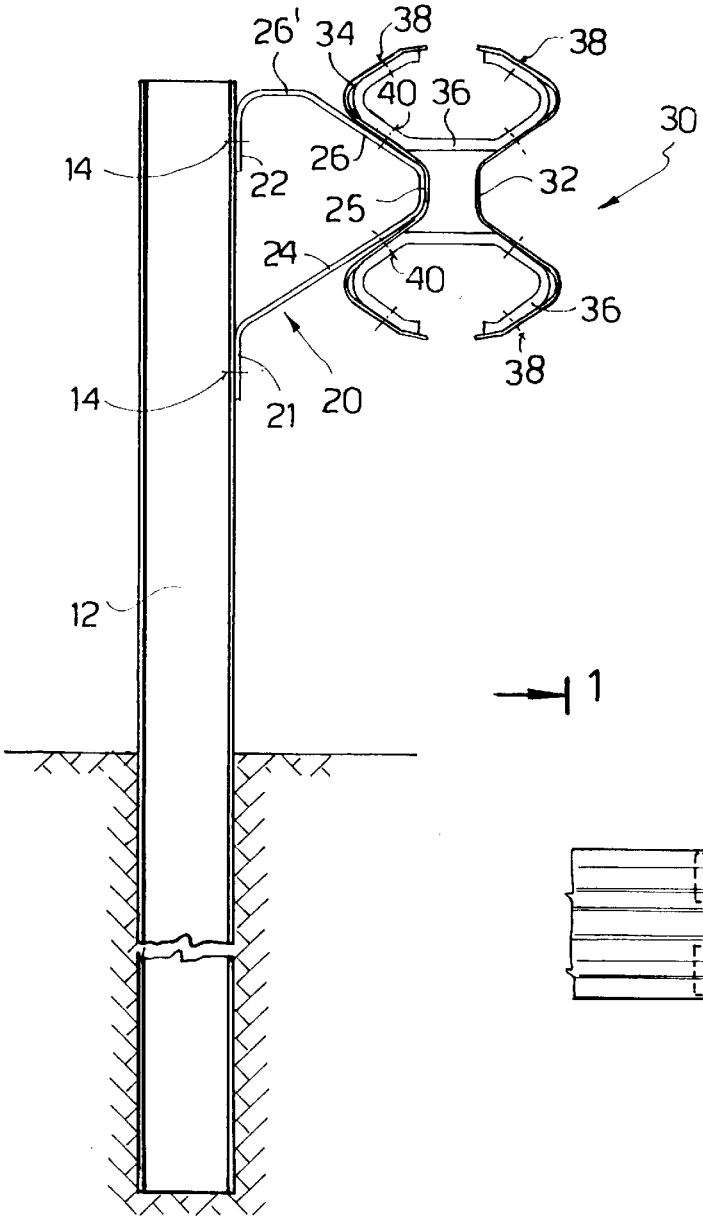
FIG. 1 is a sectional view of a first embodiment of a guardrail according to the invention, on a reduced scale; the section is taken along the vertical plane 1—1 in FIG. 2.
Figure 2:
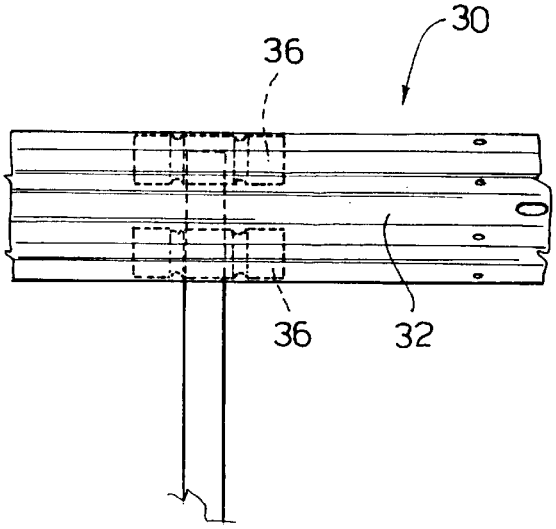
FIG. 2 is a broken-away front view of a portion of the guardrail in FIG. 1, reduced in scale with respect to said figure.

The invention will now be described in its simplest embodiment with reference to FIGS. 1 to 5.

A guardrail 10 in said figures comprises a plurality of spaced out uprights or vertical posts, 12, made of metal section bar, for example I-beam or channel-beam, a substantial portion of which, indicatively about 1200 mm, is fixed in the ground and another portion of which protrudes from the ground.

Spacers 20 which will be better described below are fixed to the posts 12 by nuts and bolts (the bolts are not shown but their axes are indicated by 14). A longitudinal rail 30 is applied to the spacers 20 and fixed by means of nuts and bolts.

Each spacer 20 (FIGS. 6 and 7) is made of sheared and bent sheet steel and is substantially C-shaped, comprising end fixing tongues 21 and 22, an inclined lower portion (preferably inclined about 57° with respect to the vertical) indicated by 24, a substantially vertical middle portion 25, and an upper portion that is curved or comprises an inclined portion 26 (about 56° with respect to the vertical) and a horizontal portion 26' that ends with tongues 22.

Figure 8:
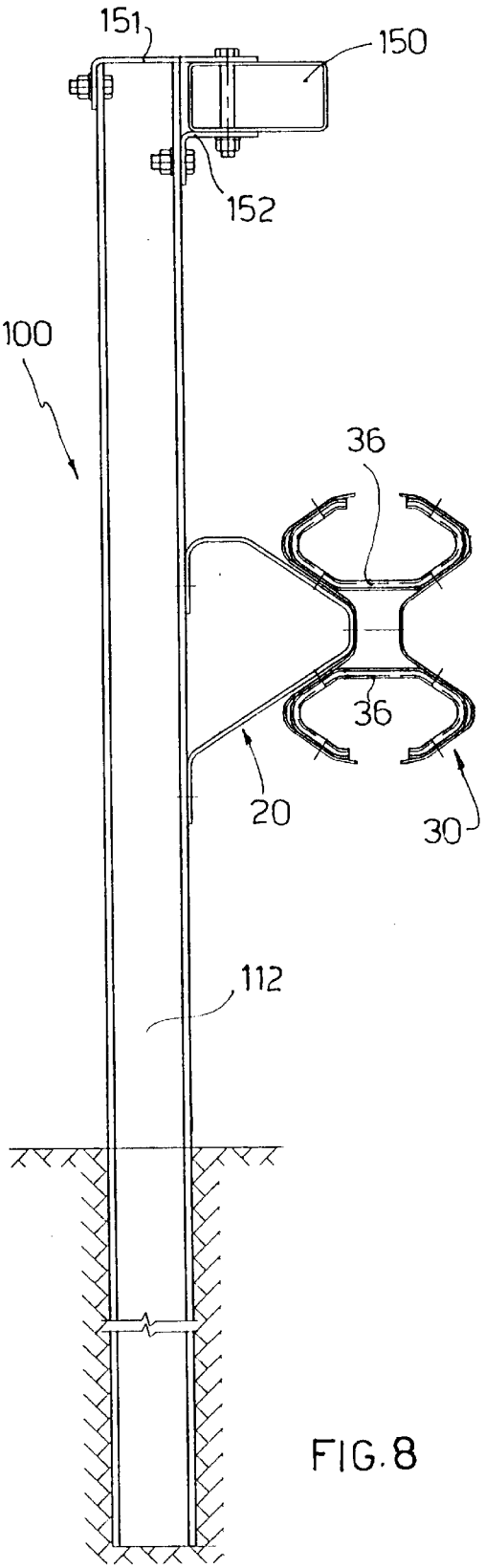
FIG. 8 is a vertical section of a variant of the guardrail.

The longitudinal rail 30 comprises two longitudinal strips 32, 34 with a double wave-shaped profile, arranged one specularly to the other, that is to say facing each other to define on FIG. 8 profile, joined together at intervals by arched ribs or cross stiffening brackets 36. The ribs 36 are preferably situated to coincide with each upright and each spacer. Each sheet metal rib (FIGS. 3, 4, 5) is substantially C-shaped with the arms of the C substantially corresponding to the shape of the facing waves of the strips, with the opening of the C disposed in the distal part of the strips. The connection between each rib and the pair of strips is made by means of bolts 38, whilst bolts 40 join together the rib, the strip and the spacer. Each rib has a longitudinal extension which is about three times its height and is interrupted by stiffening beads 42, made by deformation of the sheet.

The particular shape of the longitudinal rail and the spacers allows a high impact force to be absorbed, mainly through deformation of the spacers, which moreover, as they are deformed, cause lifting of the longitudinal rail which helps straighten the vehicle and prevent it from overturning.

Figure 9:
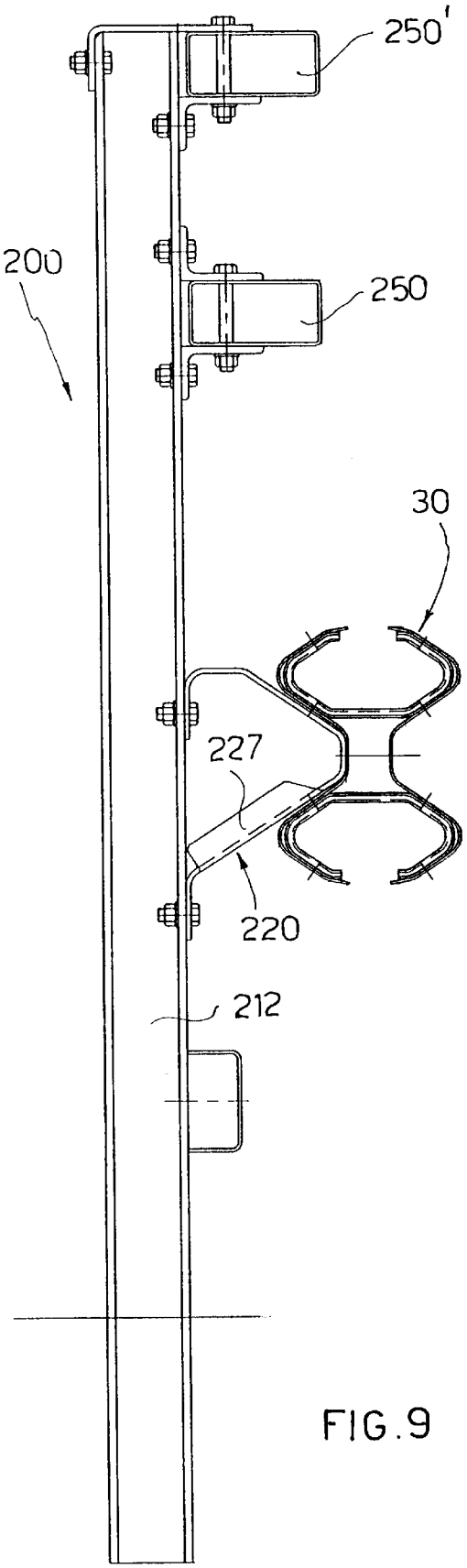
FIG. 9 is a vertical section of a further variant of the guardrail.
Figure 10:
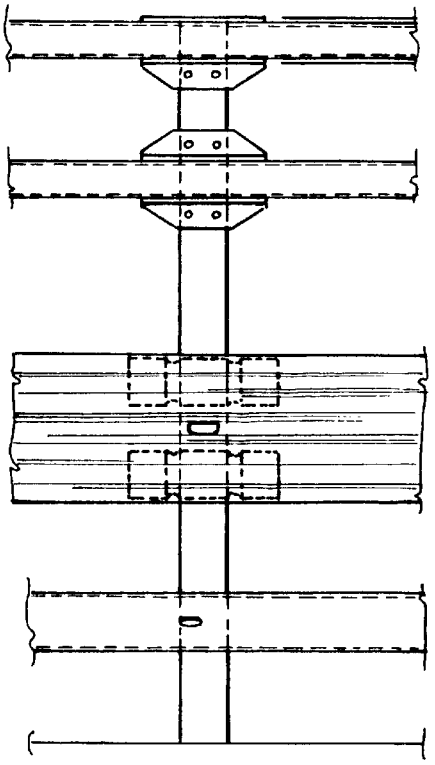
FIG. 10 is an interrupted front view of the guardrail in FIG. 9.
Figure 14:
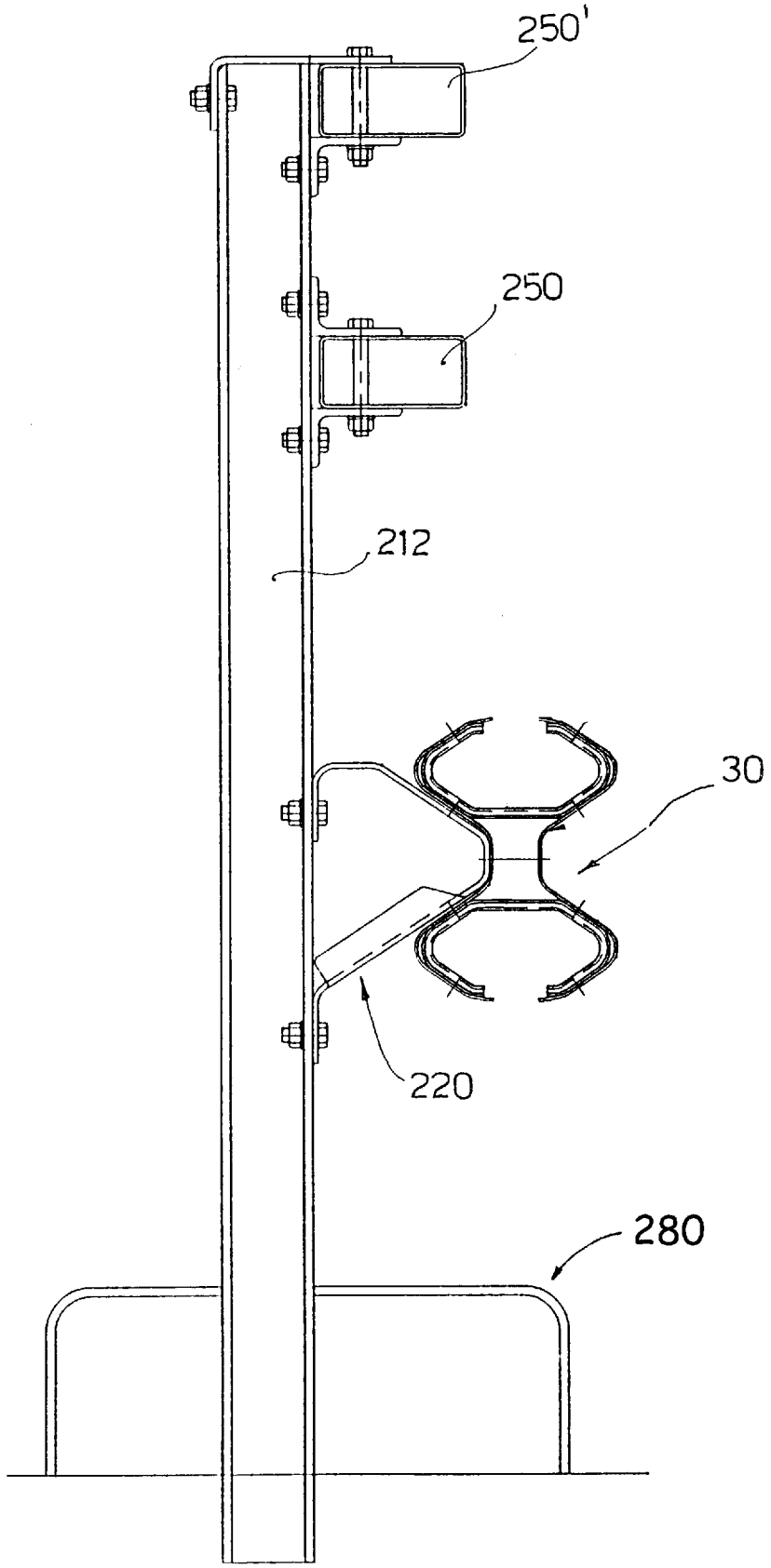
FIG. 14 is a vertical section of a guardrail according to the invention in a further embodiment.

FIG. 14 illustrates an embodiment of the guardrail similar to that of FIG. 9, in which the upright 212 is supported by a base 280 rather than mounted directly in the ground.

A variant of the guardrail illustrated in FIG. 8 is indicated by reference numeral 100 and is suitable for sustaining heavier loads than the guardrail in FIG. 1. The elements of the guardrail 100 that correspond to the elements of the guardrail 10 have the same reference numerals and will not be described in detail. The uprights 112 of the guardrail 100 have a greater height than that of the uprights 12 of the previous guardrail, in particular they extend for a certain distance above the height of the longitudinal rail 30. The upper ends of the uprights 112 carry an upper longitudinal element 150, generally tubular, fixed to said uprights by means of connection plates 151 and 152. The connection plates 151, 152, the upright and the tubular element are fixed together by means of nuts and bolts. The tubular element 150 generally has a rectangular section with chamfered comers and, with respect to the carriageway, is set back with respect to the longitudinal rail 130.

Figure 13:
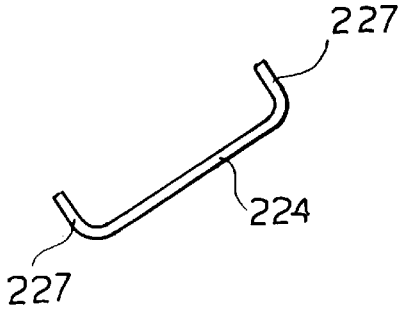
FIG. 13 is a section along 13—13 in FIG. 11.
Figure 11:
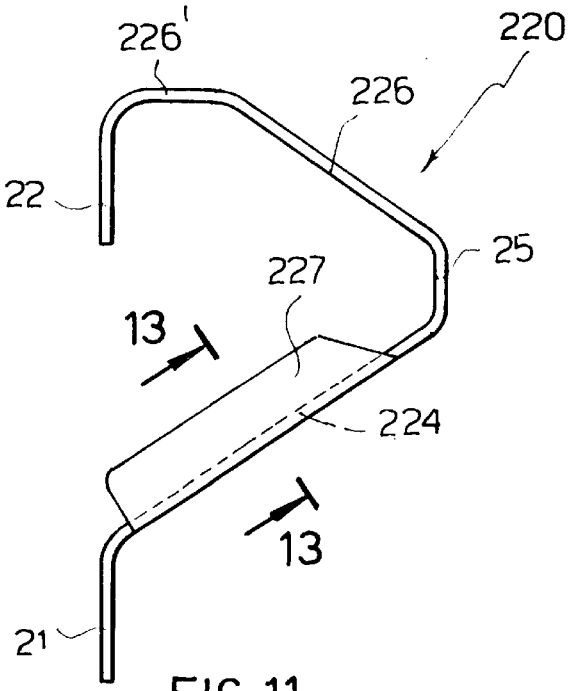
FIG. 11 is a view of a variant of the spacer element used in the barrier in FIG. 9.
Figure 12:
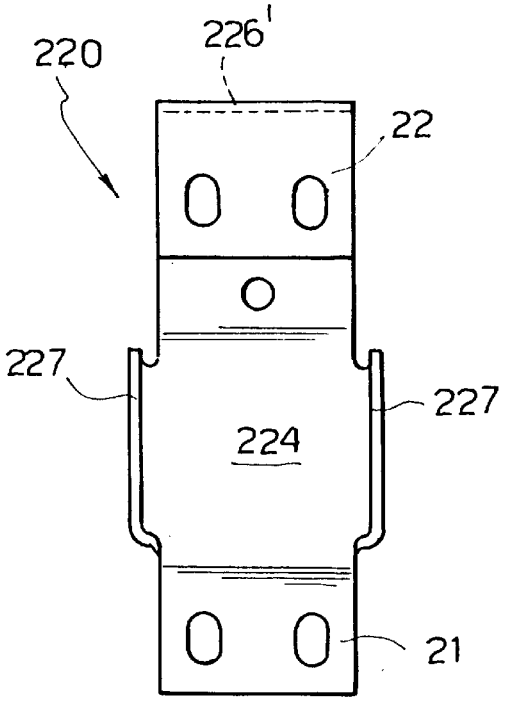
FIG. 12 is a rear view of the spacer element in FIG. 10, that is to say a view from the left of said figure.

FIG. 9 shows a further variant of the guardrail able to withstand even heavier impacts than the guardrail in FIG. 8. The guardrail 200 in FIG. 9 comprises elements corresponding to those of the guardrail in FIG. 1, which have the corresponding reference numerals and will not be described in detail here. In the case in FIG. 9, a spacer 220 (FIGS. 11–13) has flanges indicated by 227 on the sides of the inclined portion 224. The spacer 220 has the property of being able, when deformed, to absorb the force of impact, the flanges 227 thereof enfolding the upright 212 on one side and the other, helping to avoid longitudinal shifting between the elements of the guardrail. The spacer 220 can be used with any guardrail according to the invention.

The guardrail 200 further comprises two longitudinal vertically spaced tubular elements 250 and 250', applied to the upright 212 so that their ends towards the carriageway are set back towards the upright with respect to the longitudinal rail 30. A preferred height for the two longitudinal elements 250, 250' is about 1250 mm from the road surface for the bottom longitudinal element and 1550 mm from the road surface for the top longitudinal element. These dimensions are, however, subject to variation.

It will be noted that the guardrails 10, 100, 200 leave an ample free space between the longitudinal rail and longitudinal elements, so that the occupants of the vehicles travelling along the carriageway can see the view.

Figure 15:
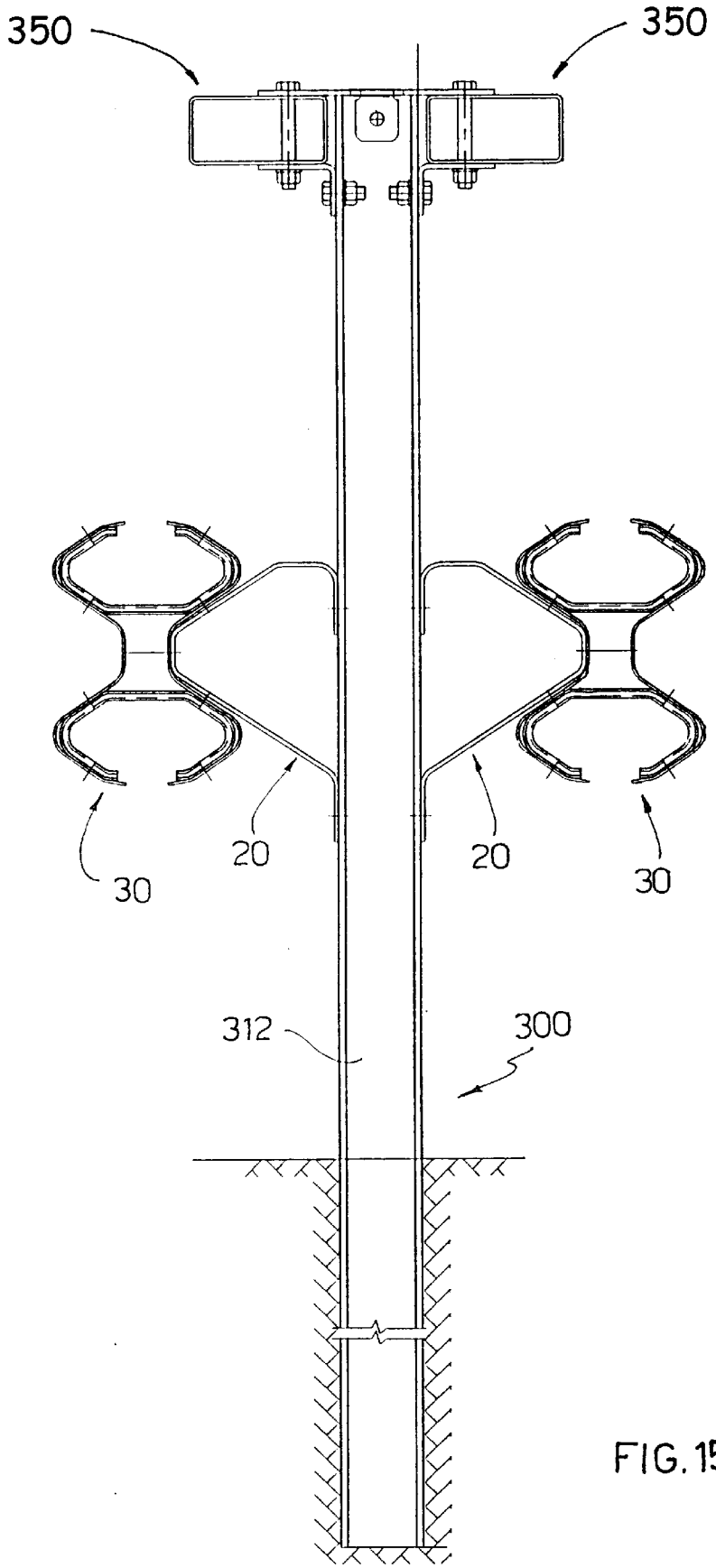
FIG. 15 is a vertical section of a further variant of the guardrail.

FIG. 15 illustrates a variant 300 of the guardrail, suitable as a directional separator or traffic divider. The variant 300 comprises elements corresponding to those of the other guardrails which are indicated with the same reference numerals and will not be described in detail. The guardrail 300 in particular comprises spacers 20 and longitudinal rails 30 on both sides 312 of the uprights. The guardrail 300 can further comprise one or more upper longitudinal elements 350, on each side of the uprights.

The guardrails described are made of sheet metal, particularly sheet metal that withstands atmospheric agents, such as, indicatively, COR-TEN sheet steel.

I claim:

1. A guardrail for a roadway, comprising:

uprights for positioning in spaced out arrangement along a roadway;

a longitudinal rail carried on a first lateral side of the uprights, said longitudinal rail including a pair of metal longitudinal strips, each strip having a double wave shaped profile, the strips arranged facing each other to define two cavities in a figure 8 profile;

connecting ribs disposed between said two longitudinal strips and fastening said strips together, wherein said connecting ribs are made of sheet metal, have a C-shaped profile and are arranged in pairs, one of said ribs being disposed in each cavity formed by the longitudinal strips and wherein said ribs are fastened to said longitudinal strips; and deformable spacers mounted to said uprights and connecting said uprights and one of said longitudinal strips to carry said rail.

2. A guardrail according to claim 1, wherein said spacers are made of sheet metal, are C-shaped and comprise a first inclined lower portion, an intermediate portion and an upper portion.

3. A guardrail according to claim 2, wherein said inclined lower portion is inclined about 57° with respect to the vertical when the spacer is mounted on the upright.

4. A guardrail according to claim 2, wherein the lower inclined portion includes upturned flanges at opposite sides of the inclined portion with a space between the flanges not smaller than the width of the upright.

5. A guardrail according to claim 2, wherein the upper portion is shaped with a curvature.

6. A guardrail according to claim 2, wherein the upper portion is shaped with a composite bend.

7. A guardrail according to claim 1, further comprising, above said longitudinal rail and at a distance therefrom, at least one longitudinal element carried on said uprights and projecting laterally from said uprights a distance less than a distance said longitudinal rail projects laterally from said uprights.

8. A guardrail according to claim 7, wherein said longitudinal elements are tubular metal sections fixed to the uprights.

9. A guardrail according to claim 1, further comprising a second longitudinal rail mounted on a second side of the uprights laterally opposite said longitudinal rail on the first side.

10. A guardrail according to claim 9, further comprising upper longitudinal elements mounted to the uprights on said first and second sides of the uprights at a position above the longitudinal rails.

11. A guardrail according to claim 1, further comprising a second longitudinal rail mounted on a second side of the uprights laterally opposite said longitudinal rail on the first side.

12. A guardrail according to claim 11, further comprising upper longitudinal elements mounted to the uprights on said first and second sides of the uprights at a position above the longitudinal rails.

13. A guardrail for a roadway, comprising:

uprights for positioning in spaced out arrangement along a roadway;

a longitudinal rail carried on a first lateral side of the uprights, said longitudinal rail including a pair of metal longitudinal strips, each strip having a double wave shaped profile, the strips arranged facing each other to define a figure 8 profile;

connecting ribs disposed between said two longitudinal strips and fastening said strips together; and deformable spacers mounted to said uprights and connecting said uprights and one of said longitudinal strips to carry said rail, wherein each spacer has a lower portion extending diagonally from the rail to a position on the upright below a height of the rail, and an upper curved portion, so that the upper portion collapses in response to a collision force to raise the longitudinal rail.

14. A guardrail according to claim 13, wherein said connecting ribs are made of sheet metal, have a C-shaped profile and are arranged in pairs, one of said ribs being disposed in each cavity defined by said figure 8 profile defined by the longitudinal strips, and wherein said ribs are fastened to said longitudinal strips.

15. A guardrail according to claim 13, wherein said spacers are made of sheet metal, are C-shaped and comprise a first inclined lower portion, an intermediate portion and an upper portion.

16. A guardrail according to claim 15, wherein said inclined lower portion is inclined about 57° with respect to the vertical when the spacer is mounted on the upright.

17. A guardrail according to claim 15, wherein the lower inclined portion includes upturned flanges at opposite sides of the inclined portion with a space between the flanges not smaller than the width of the upright.

18. A guardrail according to claim 13, further comprising, above said longitudinal rail and at a distance therefrom, at least one longitudinal element carried on said uprights and projecting laterally from said uprights a distance less than a distance said longitudinal rail projects laterally from said uprights.

19. A guardrail according to claim 18, wherein said longitudinal elements are tubular metal sections fixed to the uprights.

* * * * *